US008480542B2

(12) United States Patent
Reggiani

(10) Patent No.: US 8,480,542 B2
(45) Date of Patent: Jul. 9, 2013

(54) GYMNASTIC MACHINE

(75) Inventor: Simone Reggiani, Bologna (IT)

(73) Assignee: Technogym S.p.A., Gambettola (FC) (IT)

( * ) Notice: Subject to any disclaimer, the term of this patent is extended or adjusted under 35 U.S.C. 154(b) by 26 days.

(21) Appl. No.: 12/953,820

(22) Filed: Nov. 24, 2010

(65) Prior Publication Data

US 2011/0130250 A1 Jun. 2, 2011

(30) Foreign Application Priority Data

Nov. 27, 2009 (IT) ..... RA2009A0044

(51) Int. Cl.
*A63B 21/00* (2006.01)

(52) U.S. Cl.
USPC ..... 482/51; 482/71

(58) Field of Classification Search
USPC ..... 482/51, 71, 54, 57, 63, 80, 903
See application file for complete search history.

(56) References Cited

U.S. PATENT DOCUMENTS 4,838,544 A * 6/1989 Sasakawa et al. ..... 482/62
5,137,501 A * 8/1992 Mertesdorf ..... 482/57
5,466,203 A * 11/1995 Chen ..... 482/63
6,626,804 B2 * 9/2003 Wang et al. ..... 482/63
2006/0217234 A1 9/2006 Rodgers
2007/0219062 A1 9/2007 Rodgers
2009/0203501 A1 8/2009 Rodgers
2010/0167883 A1 * 7/2010 Grind ..... 482/71

OTHER PUBLICATIONS

European Search Report dated Jul. 26, 2010.

* cited by examiner

*Primary Examiner* — Jerome W Donnelly
(74) *Attorney, Agent, or Firm* — Abelman, Frayne & Schwab

(57) ABSTRACT

A gymnastic machine (1) comprising a frame (10) supporting a first actuating device (40) provided with at least a pair of first levers (102)(104), each of which presents a respective implement (112)(116) suitable to act as user interface; a load unit (300) being provided in connection with the first levers (102) so as to dissipate power applied to each implement (112)(116) in a proportion definable at will; said load unit (300) being designed to maintain the first levers (102)(104) in phase opposition; second actuating devices (50) of magnetic kind being associated with the load unit (300) to bring and maintain the first levers (102)(104) at rest in a neutral position so as to prevent stopping conditions.

9 Claims, 2 Drawing Sheets

GYMNASTIC MACHINE

FIELD OF THE INVENTION

The present invention relates to a gymnastic machine. In particular, the present invention relates to a gymnastic machine provided with a load group that can be actuated cyclically. In more detail, the present invention relates to a gymnastic machine comprising a load group that can be actuated cyclically through at least one actuating member designed to be movable along an annular path.

BACKGROUND TO THE INVENTION

In the sector of gymnastic machines for cardiovascular training, the use is well known of load groups provided with at least one rotating mechanical member carried by a frame of the machine and designed to act as dissipater of power exerted by a user on an implement coupled to the mechanical member directly or indirectly, through the interposition of a transmission device. Such a mechanical member, generally comprising a flywheel, presents a significant mass, to make the power exchange with the user easier during the machine operation, and, at the end of the training exercise, maintains its condition of rotary motion until the inertial torque associated with the flywheel is balanced by the resistant torque deriving from the combined action of the frictions present in the pair of members in relative motion, and of the inertia of the members usable for the actuation. It is easily understood that the flywheel stops when the inertial torque, linked to the rotating mass thereof, becomes lower than the resistant torque typical of the movable members of the machine that are connected to the flywheel. When this condition occurs, the flywheel is preferably arranged in a position, to which a given arrangement of the movable members of the machine corresponds, that can match with a stopping condition that must be released to allow starting of the machine from the rest operating condition. In particular, to release the machine it will be necessary to actuate contrarily the members used for the actuation and it can require great efforts for users with athletic preparation of any level. Obviously, such a problem occurs also in machines where the resistant/load group is of the electromechanical type.

In view of the above description, the problem of having available a machine for cardiovascular training, where the condition of mechanical block can be avoided, is currently unsolved, and represents an interesting challenge for the applicant, in order to facilitate these types of training through mechanical or electromechanical machines.

In view of the situation described above, it would be desirable to have available an economical safe gymnastic machine which, in addition to enabling to limit and possibly to overcome the typical drawbacks of the prior art illustrated above, could define a new standard for the cardiovascular training methods.

SUMMARY OF THE INVENTION

The present invention relates to a gymnastic machine. In particular, the present invention relates to a gymnastic machine provided with a load group that can be actuated cyclically. In more detail, the present invention relates to a gymnastic machine comprising a load group that can be actuated cyclically through at least one actuating member movable along an annular path.

The object of the present invention is to provide a gymnastic machine for executing gymnastic exercises, which allows the disadvantages described above to be solved, which is practical in use and economical, and which is suitable to satisfy a plurality of requirements that to date have still not been addressed, capable of modifying the current market of the gymnastic machines and the training techniques, and therefore suitable to represent a new and original source of economic interest.

According to the present invention, a gymnastic machine is provided, whose main characteristics will be described in at least one of the appended claims.

BRIEF DESCRIPTION OF DRAWINGS

Further characteristics and advantages of the gymnastic machine according to the present invention will be more apparent from the description below, set forth with reference to the accompanying drawings, which illustrate at least one non-limiting example of embodiment, in which identical or corresponding parts of the device are identified by the same reference numbers. In particular.

DETAILED DESCRIPTION OF THE INVENTION

Figure 1:
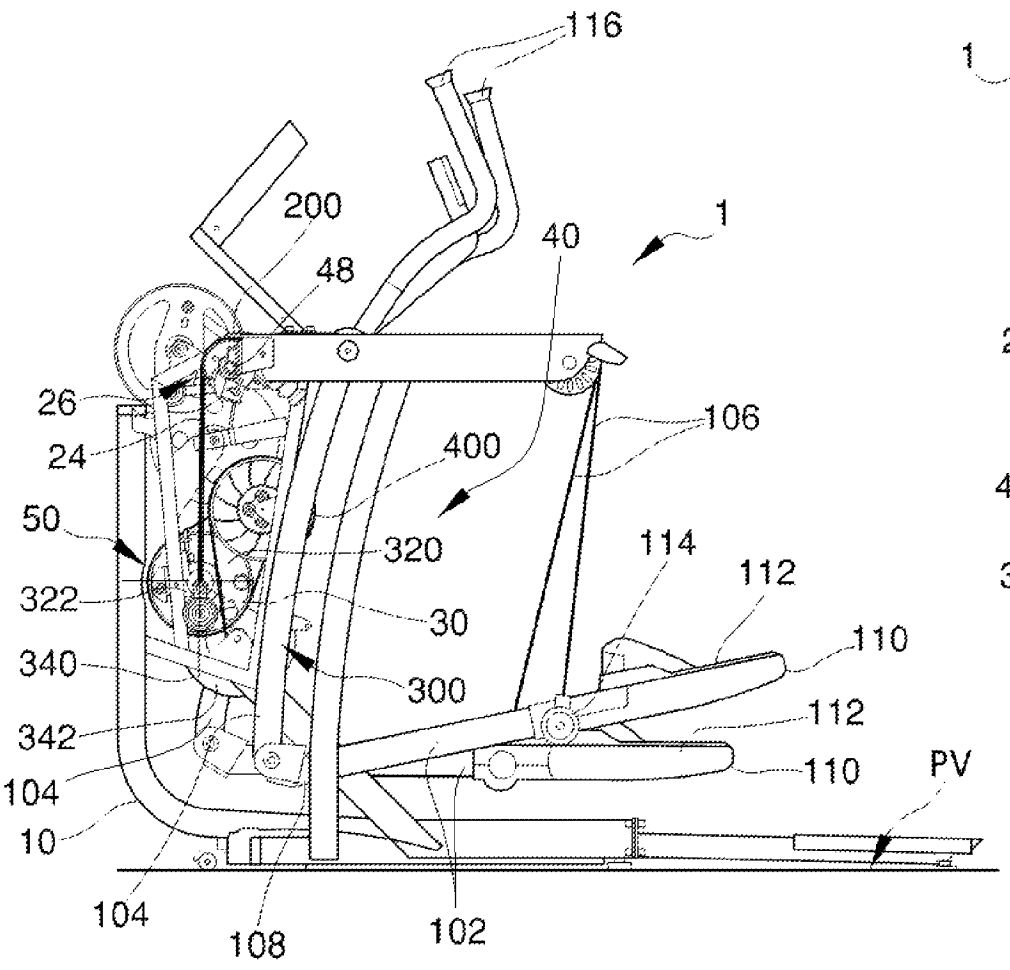
FIG. 1 is a side elevation view with some parts removed for the sake of clarity of a machine according to the present invention.

In FIG. 1, number 1 indicates, in its entirety, a gymnastic machine validly usable for executing an aerobic gymnastic exercise, and therefore for training the cardiovascular system. It should be noted that, for the sake of practicality, without however limiting the protective scope of the present invention, the gymnastic machine 1 is of the type already described with reference to the Italian patent application No. RA2008A000045, whose description and mosaics shall be considered an integral part of the present description for saving text and drawings, when indicated, even if the reference numbers used to indicate identical parts different from each other for description requirements.

With reference to FIG. 1 again, the machine 1 comprises a frame 10, an actuating device 40 provided with a pair of first levers 102, each of which is supported by the frame 10 through the interposition of a second lever 104, pivoted on the frame 10 and through a first flexible member 106, better described below, which supports the first lever 102 in intermediate position through an articulated connection 114.

Each first lever 102 is therefore connected to the frame 10 so as to oscillate similarly to a connecting rod of a four bar linkage relative to the frame 10. Each first lever 102 presents an end portion 108 shaped to couple with the lever 104; each first lever 102 furthermore presents a free end 110 at opposite side from the end portion 108 and provided with a footrest 112. In view of the above description, each footrest 112 is arranged substantially overhanging behind the connection 114 in FIG. 1. Each second lever 104 presents, at opposite side relative to the end portion 108 of the corresponding first lever 102, a knob 116, that is tiltable relative to the frame 10 in view of the above description and can be held by a user for moving the upper limbs. The machine 1 furthermore comprises a load device 300 arranged at the side of the end portion 108 of the first lever 102, without however limiting the protective scope of the present invention. This load device 300 is provided with a flywheel 320 carried by the frame 10 in a freely rotatable manner around a given substantially horizontal pivot axis 30, as shown in FIG. 1. This flywheel 320 is kinematically connected with the actuating device 40 through a transmission 200, already described with reference to the patent application No. RA2008A000045 and functionally recalled hereafter with the minimum required detail, for the sake of practicality. In addition to the first flexible member 106 and to the respective return members, not described for the sake of practicality, this transmission 200 furthermore comprises, for each first lever 102, a crank 322, rigidly coaxially connected with the flywheel 320. The transmission 200 furthermore comprises, for each crank 322, a second flexible member 24, already known from the patent application No. RA2008A000045 and connected with the corresponding first flexible member 106 through a joint 26, which is associated with the frame 10 and is already known from the same patent application No. RA2008A000045. The two cranks 322 are mutually opposite, i.e. they are in phase opposition, so as to put the flywheel 320 into rotation under the thrust of the two footrests 112 through the first and second flexible members 106 and 24. The particular arrangement of the cranks 322 maintains therefore the levers 102 constantly in phase opposition.

In view of the above description, in the machine 1 taken herein as a reference to illustrate an embodiment of the present invention, the footrests 112 are constrained to move along an horizontally elongated elliptical trajectory, extending vertically for a limited width, and therefore the machine 1 can be used for walking or running training.

As it is well known, the flywheel 320 comprises a circular member with significant mass, whose object is, in use, to store rotational kinetic energy produced by actuating the footrests 112 and/or the knobs 106 to smooth the execution of the gymnastic exercise performed through the machine 1. The flywheel 320 acts therefore as a power dissipater member until the rotation speed in the starting phase of the machine 1 achieves a substantially constant value and, during the use thereof under steady-state conditions, it acts as accumulated power "reserve" to facilitate preservation of a steady-state operation. The presence of the flywheel 320 therefore makes the stop times of the machine 1 longer, in phase of conclusion of the exercise.

It should be noted that a stopping condition of the machine 1 can occur when the belt 24 is arranged according to the vertical, the cranks 322 are aligned with the belt 24 and the first levers 102 are arranged in a scissor manner, in the respective top and bottom dead centres.

The loading device 300 furthermore presents a power dissipating member of the adjustable type comprising an electromagnetic brake 340 carried by the frame 10 and provided with a rotating disk 342 mechanically connected to the flywheel 320 in an angularly fixed manner through a further belt transmission 400 with parallel axes. The loading device 300 therefore combines partially fixed and partially adjustable mechanical characteristic, respectively set by the flywheel 320 and by the brake 340. The transmission 400 can be single- or multi-stage. In particular, although without limiting the protective scope of the present invention, in the attached drawings this transmission 400 is double-stage. The object of this transmission 400 is to modify the kinematic parameters of the disk 342 of the brake 340 relative to those of the flywheel 320 and of the first levers 102, responsible for the actuation of all the moving parts of the machine 1 to improve the performances of the brake 340.

Figure 2:
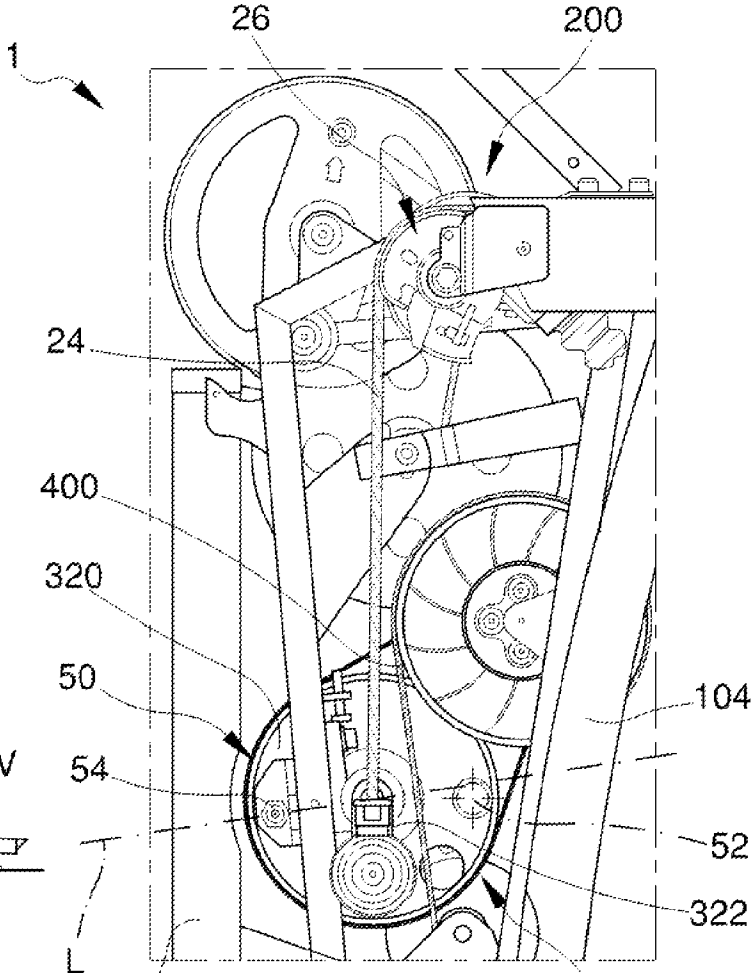
FIG. 2 is a view in enlarged scale and with some parts removed for the sake of clarity of a portion of FIG. 1.
Figure 3:
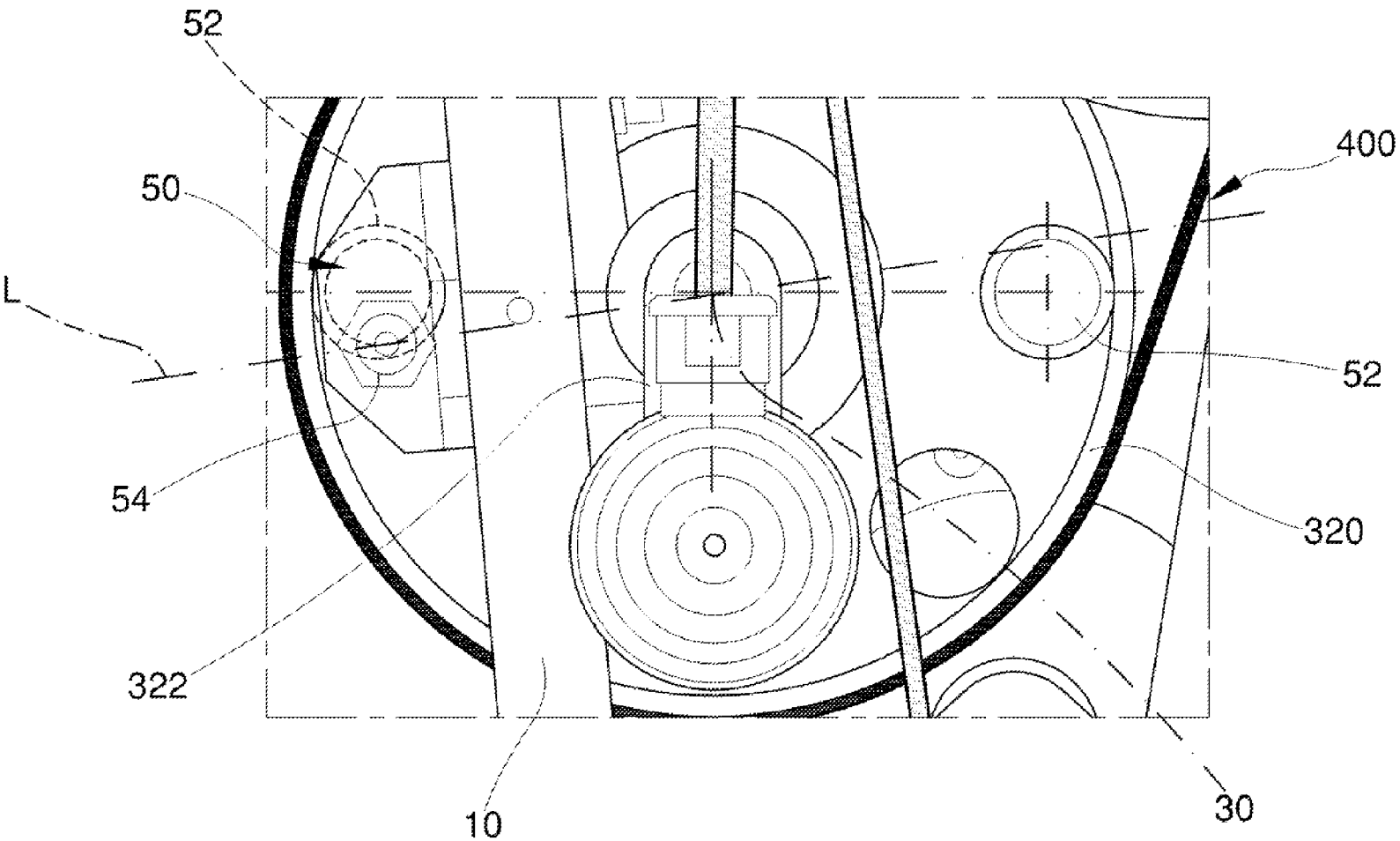
FIG. 3 is a view in enlarged scale and with some parts removed for the sake of clarity of a portion of FIG. 2.

The machine 1 furthermore comprises an anti-stopping device 50 associated with the flywheel 320 and comprising at least one magnet 52 carried by the flywheel 320. In particular, with reference to FIG. 3, the anti-stopping device 50 comprises a pair of movable magnets 52 carried by the flywheel 320. These magnets 52 are diametrically opposite, analogously to the cranks 322, and are generally displaced relative to a quadrature condition with these latter for reasons that will be more apparent below. This anti-stopping device 50 furthermore comprises a fixed magnet 54, carried by the frame 10 in a position facing each movable magnet 52. In particular, the frame 10 carries the fixed magnet 54 at a height substantially identical to the distance of the trace of the axis 30 in FIG. 1 relative to a pavement PV, on which the machine 1 stands, so that the two movable magnets 52 are substantially equidistant from the fixed magnet 54 when the flywheel 320 is arranged with the cranks 322 substantially horizontal, in an arrangement visible in FIG. 1 and, in more detail, in FIG. 3. In view of the above description, the movable magnets 52 and the fixed magnet 54 are arranged at a substantially identical radial distance from the pivot axis 30 of the flywheel 320, so as to exert on the flywheel 320 a torque of magnetic nature suitable to constrain the flywheel 320 to take a given operating position relative to the frame 10. To achieve this, the movable magnets 52 and the magnet 54 present homologous opposite magnetic poles and the magnetic repulsion force exchanged between the homologous poles of each magnet 52 and of the magnet 54 is maximum when these magnets face each other. This repulsion force decreases significantly in case of even minimum displacement between a magnet 52 and the magnet 54, i.e. the case where the magnetic torque on the flywheel 320 appears. This explains why the arrangement of the magnets 52 on the flywheel 320 in not in quadrature with the cranks 322, as, in that case, the repulsion force could be maximum but the stopping condition could not be overcome easily due to the condition of a magnet 52 facing the magnet 54. Therefore, each crank 322 is normally displaced relative to the magnet 52 by an angle different than 90°. A confirmation of this situation can be obtained graphically in FIG. 2 and, in enlarged scale, in FIG. 3, observing the straight line L and the angle with the straight line connecting the centres of the two movable magnets 52, and the inclination of the flexible member 24 relative to a vertical direction, in particular in FIG. 2. These figures show a situation of down time, wherein, due to the interaction between the adjacent magnets 52 and 54, the cranks 322 move away from the vertical position, thus making impossible to detect the stopping condition.

Obviously, the choice of the movable magnets 52 and of the fixed magnet 54 is made to have available, when the movable magnets 52 and the fixed magnet 54 are slightly displaced from each other, a sufficient torque to move the cranks 322 from the stopping position and, consequently, the first levers 102 from the scissor position.

To this position of the cranks 322 can therefore correspond any rest position of the first levers 102, provided that it is different from the scissor arrangement of the first levers 102 visible in FIG. 1.

In view of the above description, the anti-stopping device 50 can be interpreted as a second actuating device, that acts when there is no external load acting on the first levers 102 or on the second levers 104.

The use of the gymnastic machine 1 described above is readily apparent in view of the above description and requires no additional explanations.

Lastly, it is apparent that modifications and variants can be made to the gymnastic machine 1 described and illustrated herein, without however departing from the protective scope of the present invention.

For instance, it is easily understood that the movable magnets 52 and/or the fixed magnet 54 can be of the permanent type or they can be electromagnets powered by an electric current adjustable in a known and therefore not shown manner, so as to produce a magnetic field with intensity variable also instant by instant, to avoid stopping conditions of the first/second levers 102/104 even with internal friction between the moving members of the machine 1 greater than the project conditions. For this purpose it should be advisable to complete the outfit of the gymnastic machine with a power-supply unit, no-load resistance sensors and an electronic unit to which connect the sensors and the magnets so as to vary adequately the parameters of the electric current to supply to these latter.

In view of the above description it is clearly apparent that each gymnastic machine 1 structured as described above is suitable to be used, starting from the rest condition, also by deconditioned users or users who could feel awkward in performing opposite actuation operations of the machine they want to use to perform a cardiovascular training session.

I claim:

1. A gymnastic machine comprising:

a frame supporting first actuating means provided with at least a pair of first levers, each of said first levers including a respective user interface;

loading means connected with said first levers for dissipating power applied to each said user interface in a proportion definable at will and for maintaining said first levers in phase opposition; and second actuating means of magnetic nature being associated with said loading means for bringing and maintaining said first levers in a rest position and for preventing stopping conditions of said first levers.

2. A machine according to claim 1, wherein said loading means comprises a first dissipating member of fixed mechanical feature and a dissipating device of adjustable mechanical feature; said first dissipating member including a flywheel carried by said frame in a freely rotatable manner about a pivot axis and a pair of cranks rigidly and coaxially coupled with said flywheel for being mutually arranged in phase opposition; each said crank being mechanically connected to a said first lever for maintaining constantly said first levers mutually in phase opposition.

3. A machine according to claim 2, wherein said second actuating means comprises at least a movable magnet, rigidly carried by said flywheel, and a fixed magnet, carried by said frame in a position facing each said movable magnet.

4. A machine according to claim 3, wherein said second actuating means comprises a pair of movable magnets carried rigidly by said flywheel and mutually diametrically opposite and displaced relative to said cranks by an angle different than 90°.

5. A machine according to claim 4, wherein said flywheel and said fixed magnet are carried by said frame at a substantially identical height, for constraining said cranks to be arranged aligned with said fixed magnet and with said pivot axis.

6. A machine according to claim 5, wherein said first actuating means comprises a pair of second levers, each of which is pivoted to said frame and to a corresponding said first lever near a respective end portion at the side of said flywheel.

7. A machine according to claim 6, wherein each said first lever is carried by said frame for oscillating through a said second lever and a first flexible member with respect to said frame; each said first lever including a footrest as user interface, and each said second lever including a handle as user interface.

8. A machine according to claims 4, wherein said movable magnets and/or said fixed magnet can be of the permanent type or current powered electromagnets, for enabling an adjustment of the driving force that can be exerted by said second actuating means to avoid conditions of stopping of said first and second levers also under conditions of friction greater than the project conditions.

9. A machine according to claim 1, wherein said dissipating device comprises an electromagnetic brake.

* * * * *